US009157221B2

(12) United States Patent
Pan

(10) Patent No.: US 9,157,221 B2
(45) Date of Patent: Oct. 13, 2015

(54) ALL-IN-ONE BATH MIXER POP-UP WASTE AND OVERFLOW ASSEMBLY

(71) Applicant: SHENG TAI BRASSWARE CO., LTD., Changhua Hsien (TW)

(72) Inventor: Chin-Chi Pan, Changhua Hsien (TW)

(73) Assignee: SHENG TAI BRASSWARE CO., LTD., Changhua Hsien (TW)

( * ) Notice: Subject to any disclaimer, the term of this patent is extended or adjusted under 35 U.S.C. 154(b) by 115 days.

(21) Appl. No.: 14/189,224

(22) Filed: Feb. 25, 2014

(65) Prior Publication Data

US 2015/0240465 A1 Aug. 27, 2015

(51) Int. Cl.
*E03C 1/232* (2006.01)

(52) U.S. Cl.
CPC ..... *E03C 1/232* (2013.01)

(58) Field of Classification Search
CPC ..... E03C 1/232
USPC ..... 4/679–694
See application file for complete search history.

(56) References Cited

U.S. PATENT DOCUMENTS

| | | | | |
|---|---|---|---|---|
| 1,443,513 | A * | 1/1923 | Weis | 112/470.05 |
| 2,964,305 | A * | 12/1960 | Samhammer et al. | 204/279 |
| 3,390,068 | A * | 6/1968 | Ellis et al. | 204/217 |
| 2014/0163664 | A1 * | 6/2014 | Goldsmith | 623/1.11 |

* cited by examiner

*Primary Examiner* — Lori Baker
(74) *Attorney, Agent, or Firm* — Birch, Stewart, Kolasch & Birch, LLP

(57) ABSTRACT

An all-in-one bath mixer assembly has a water-flow controlling apparatus, a water-draining apparatus, an overflow pipe, a pulling rope, and a water plug apparatus. The water-flow controlling apparatus has a base, a cover, a controlling rod, and a swinging rod. The cover and the controlling rod are mounted on the base; the swinging rod is mounted around the controlling rod. The water-draining apparatus is mounted on the water-flow controlling apparatus and connects with the controlling rod. The overflow pipe is connected with the water-flow controlling apparatus. The pulling rope is fixed in the water-flow controlling apparatus and is connected with the swinging rod. The water plug apparatus is connected with the overflow pipe and the pulling rope. The water-flow controlling apparatus, the water-draining apparatus and the water plug apparatus are combined together as a single apparatus and provide multiple functions for easy and quick use and installation.

15 Claims, 13 Drawing Sheets

ALL-IN-ONE BATH MIXER POP-UP WASTE AND OVERFLOW ASSEMBLY

BACKGROUND OF THE INVENTION

1. Field of the Invention

The present invention relates to a bathroom facility and more particularly to an all-in-one bath mixer pop-up waste and overflow assembly.

2. Description of Related Art

A conventional bathtub facility used in a bathtub usually has a faucet and a water plug. The faucet provides water controlling function and can control selection of hot or cold water coming out. The water plug blocks a drain of the bathtub to keep hot water stored inside of the bathtub. In addition, the bathtub further has an overflow outlet arranged in the bathtub. The overflow outlet is used for draining superfluous water from the bathtub. The faucet, the water plug and the overflow outlet usually are installed separately and are disposed around the bathtub, such that assembling, installing and operating these facilities are difficult and time-consuming.

To overcome the shortcomings of the conventional bathtub facility, the present invention provides an all-in-one bath mixer assembly to mitigate or obviate the aforementioned problems.

SUMMARY OF THE INVENTION

The main objective of the invention is to provide an all-in-one bath mixer assembly includes a water-flow controlling apparatus, a water-draining apparatus, an overflow pipe, a pulling rope, and a water plug apparatus.

The water-flow controlling apparatus has a base, a cover, a controlling rod, and a swinging rod. The cover and the controlling rod are mounted on the base. The swinging rod is mounted around the controlling rod. The water-draining apparatus is mounted on the water-flow controlling apparatus and connects with the controlling rod. The overflow pipe is connected with the water-flow controlling apparatus. The pulling rope is fixed in the water-flow controlling apparatus and is connected with the swinging rod. The water plug apparatus is connected with the overflow pipe and the pulling rope.

Other objects, advantages, and novel features of the invention will become more apparent from the following detailed description when taken in conjunction with the accompanying drawings.

DETAILED DESCRIPTION OF PREFERRED EMBODIMENT

Figure 1:
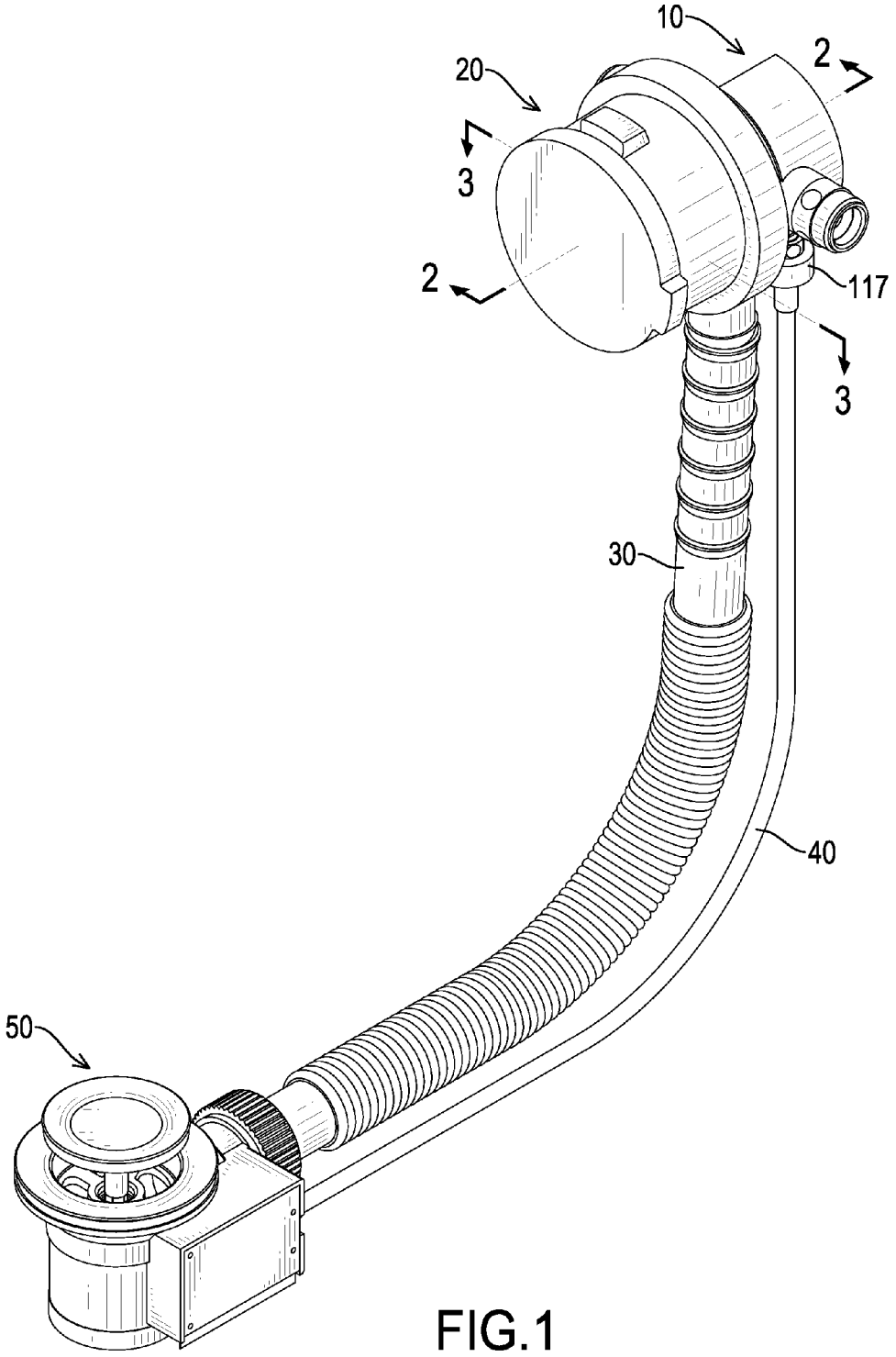
FIG. 1 is a perspective view of an all-in-one bath mixer assembly in accordance with the present invention.

With reference to FIGS. 1 to 4, a preferred embodiment of an all-in-one bath mixer assembly in accordance with the present invention has a water-flow controlling apparatus 10, a water-draining apparatus 20, an overflow pipe 30, a pulling rope 40, and a water plug apparatus 50.

With reference to FIGS. 1 to 4, the water-flow controlling apparatus 10 has a base 11, a cover 12, a controlling rod 13, a swinging rod 14 and two elastic units 15. The base 11 has a center, a left side, a right side, a bottom side, a front face 110, a back face, an axial hole 111, two inlet pipes 112, two inlet passages 113, an overflow tube 114, an outlet 115, a shell portion 116 and a positioning portion 117. The front face 110 is defined at one side of the base 11. The axial hole 11 is formed at the center of the front face 110. The inlet pipes 112 are mounted respectively on the left side and the right side of the base 11. Each inlet pipe 112 is connected with a water source. The inlet passages 113 are L-shaped and formed respectively in the inlet pipes 112. Each inlet passage 113 has an outlet opening 1131 and an abutment recess 1132 defined at the front face 110. The outlet openings 1131 are formed in the front face 110 and located respectively at two sides of the axial hole 111. The abutment recesses 1132 are formed in the front face 110 and communicate respectively with the outlet openings 1131. The overflow tube 114 is mounted on the bottom side of the base 11. The outlet 115 is formed in the overflow tube 114. The outlet 115 has an overflow opening 1151 defined at the front face 110. The shell portion 116 is fan-shaped and is formed on the back face of the base 11. The shell portion 116 has an assembling space 1161 and a shell opening 1162. The assembling space 1161 is defined in the shell portion 116. The shell opening 1162 communicates with the assembling space 1161. The positioning portion 117 is mounted on the outer surface of the overflow tube 114.

The cover 12 corresponds to and is covered on the shell opening 1162. The controlling rod 13 is inserted rotatably in the axial hole 111 and has a first end and a second end. The first end of the controlling rod 13 protrudes from the front face 110 and the second end of the controlling rod 13 extends into the assembling space 1161. The swinging rod 14 is mounted rotatably at the second end of the controlling rod 13. The elastic units 15 are mounted respectively in the abutment recesses 1132 and each elastic unit 15 has a spring 151 and a waterproof ring collar 152 abutting against the spring 151.

The water-draining apparatus 20 is mounted on the water-flow controlling apparatus 10 and has a draining switcher 21, a fixing seat 22, an adjusting plate 23 and a plug controlling plate 24.

Figure 4:
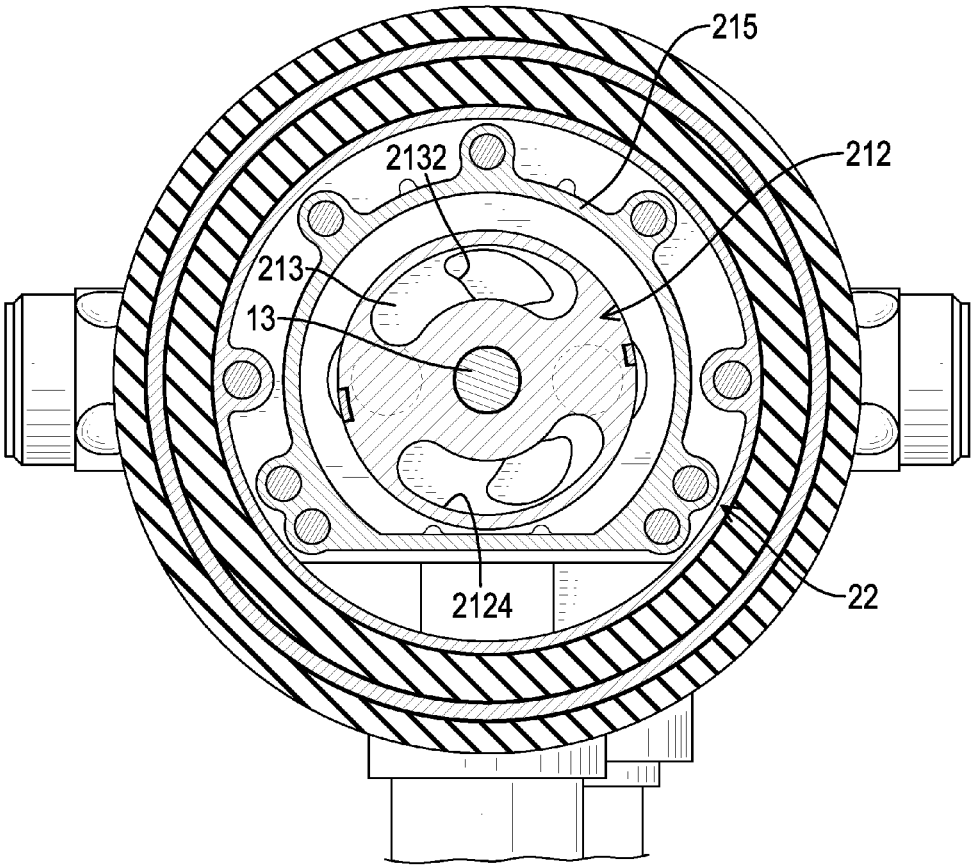
FIG. 4 is a front view in partial section of the all-in-one bath mixer assembly along line 4-4 in FIG. 3.
Figure 5:
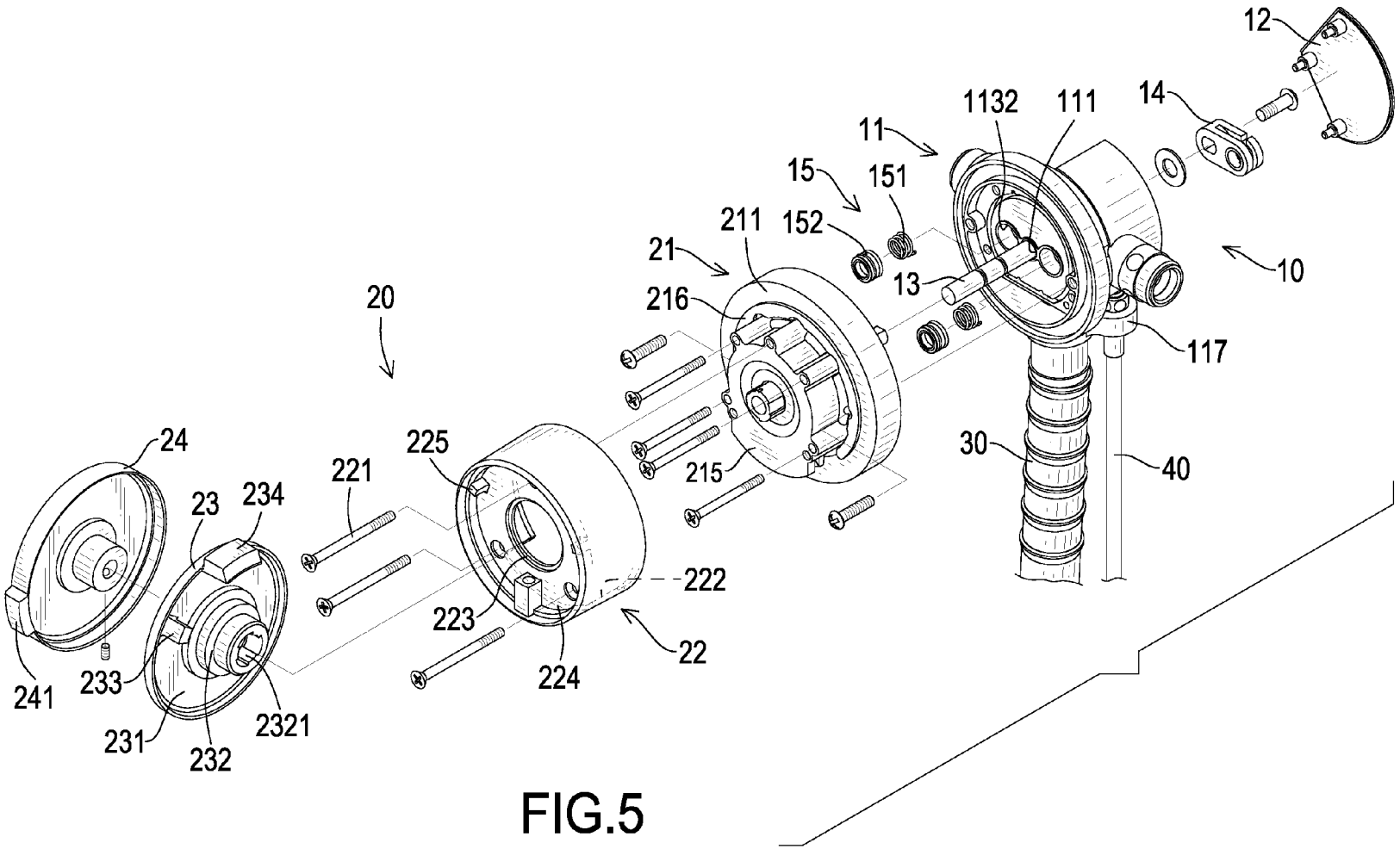
FIG. 5 is an exploded perspective view of a water-flow controlling apparatus and a water-draining apparatus of the all-in-one bath mixer assembly in FIG. 1.
Figure 6:
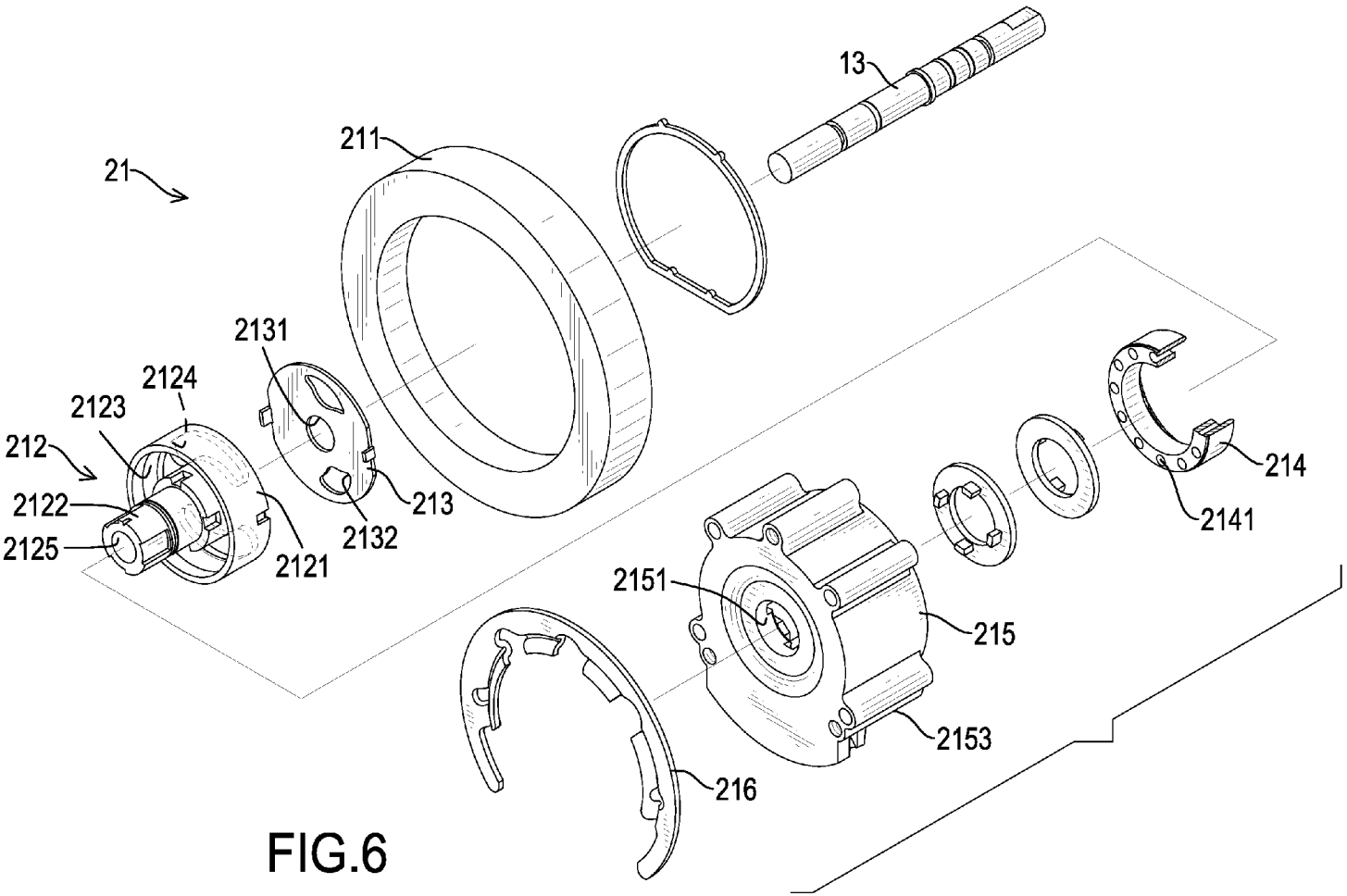
FIG. 6 is an enlarged exploded perspective view of the water-draining apparatus in FIG. 5.

With reference to FIGS. 4 to 6, the draining switcher 21 is mounted on the front face 110 of the base 11 and has a positioning ring 211, an adjusting unit 212, a water blocking disc 213, an outlet ring 214, an outlet seat 215 and an engaging plate 216. The positioning ring 211 is mounted on the periphery of the base 11. The adjusting unit 212 is mounted around the controlling rod 13 and has a cap 2121, a connecting shaft 2122, an outlet recess 2123, two water guiding holes 2124 and a shaft hole 2125. The cap 2121 has a center, a bottom face, and a side wall formed on the periphery of the bottom face. The connecting shaft 2122 is a spline shaft, is formed on the bottom face and is located at the center of the cap 2121. The outlet recess 2123 is formed around the connecting shaft 2122 and located inside the side wall of the cap 2121. The water guiding holes 2124 are curved, are mounted through the bottom face of the cap 2121, are arranged symmetrically with each other and communicate with the outlet recess 2123. The shaft hole 2125 is formed axially in the connecting shaft 2122 for the connecting shaft to be mounted around the controlling rod 13.

The water blocking disc 213 is mounted around the controlling rod 13, abuts against the elastic units 15, is engaged with the bottom face of the cap 2121 and has a center, a rod hole 2131 and two flow openings 2132. The rod hole 2131 is formed at the center of the water blocking disc 213, corresponds to and is disposed around the controlling rod 13. The flow openings 2132 are formed around the rod hole 2131 and communicate selectively and respectively with the water guiding holes 2124.

The outlet ring 214 is mounted in the outlet recess 2123 and has multiple through holes 2141. The through holes 2141 are formed longitudinally through the outlet ring 214 and are arranged in a circle. Each through hole 2141 communicates respectively with the water guiding holes 2124.

The outlet seat 215 covers the front face 110 of the base 11 and has a bottom, a center, a central hole 2151, a flowing space 2152 and a water outlet 2153. The central hole 2151 is formed at the center of the outlet seat 215. The flowing space 2152 is formed in the outlet seat 215. The adjusting unit 212 is accommodated in the flowing space 2152. The water outlet 2513 is formed at the bottom of the outlet seat 215 and communicates with the flowing space 2152. The engaging plate 216 is mounted between the positioning ring 211 and the outlet seat 215 by screws.

The fixing seat 22 is cylindrical, covers the draining switcher 21 and has a center, a bottom, a front surface, multiple bolts 221, a bottom opening 222, a central opening 223, an assembling recess 224 and three blocks 225. The bolts 221 are mounted through the fixing seat 22 and the outlet seat 215 and are screwed in the base 11. The bottom opening 222 is formed at the bottom of the fixing seat 22 and corresponds in position to the water outlet 2153. The central opening 223 is formed at the center of the fixing seat 22. The controlling rod 13 extends out of the central opening 223. The assembling recess 224 is formed in the front surface of the fixing seat 22. The blocks 225 are mounted in the assembling recess 224 and are disposed along the periphery of the front surface of the fixing seat 22 at equal intervals.

The adjusting plate 23 is mounted on the fixing seat 22 and has a cover portion 231, an engaging protrusion 232, an engaging block 233 and a pushing bar 234. The cover portion 231 is covered on the front surface of the fixing seat 22 and has a back face and a center. The diameter of the cover portion 231 is larger than the diameter of the fixing seat 22. The engaging protrusion 232 is formed at the center of the cover portion 231 and is mounted through the central opening 223 and has an engaging socket 2321. The engaging socket 2321 is a spline socket and engages correspondingly with the connecting shaft 2122. The engaging block 233 protrudes from the back face of the cover portion 231 and is located between two of the blocks 225. The pushing bar 234 is formed on the periphery of the cover portion 231 and is located out of the fixing seat 22. When the pushing bar 234 is pushed, the engaging protrusion 232 rotates the adjusting unit 212 along the periphery of the controlling rod 13 for switching the flow of water.

With reference to FIG. 5, the plug controlling plate 24 is rotatably mounted on and covers the adjusting plate 23 by screws, is fixed around the controlling rod 13, and has a pushing protrusion 241. The pushing protrusion 241 protrudes from the outer periphery of the adjusting plate 23. When the pushing protrusion 241 is pushed, the plug controlling plate 24 rotates the controlling rod 13 and the swinging rod 14, which is connected to the controlling rod 13.

Figure 2:
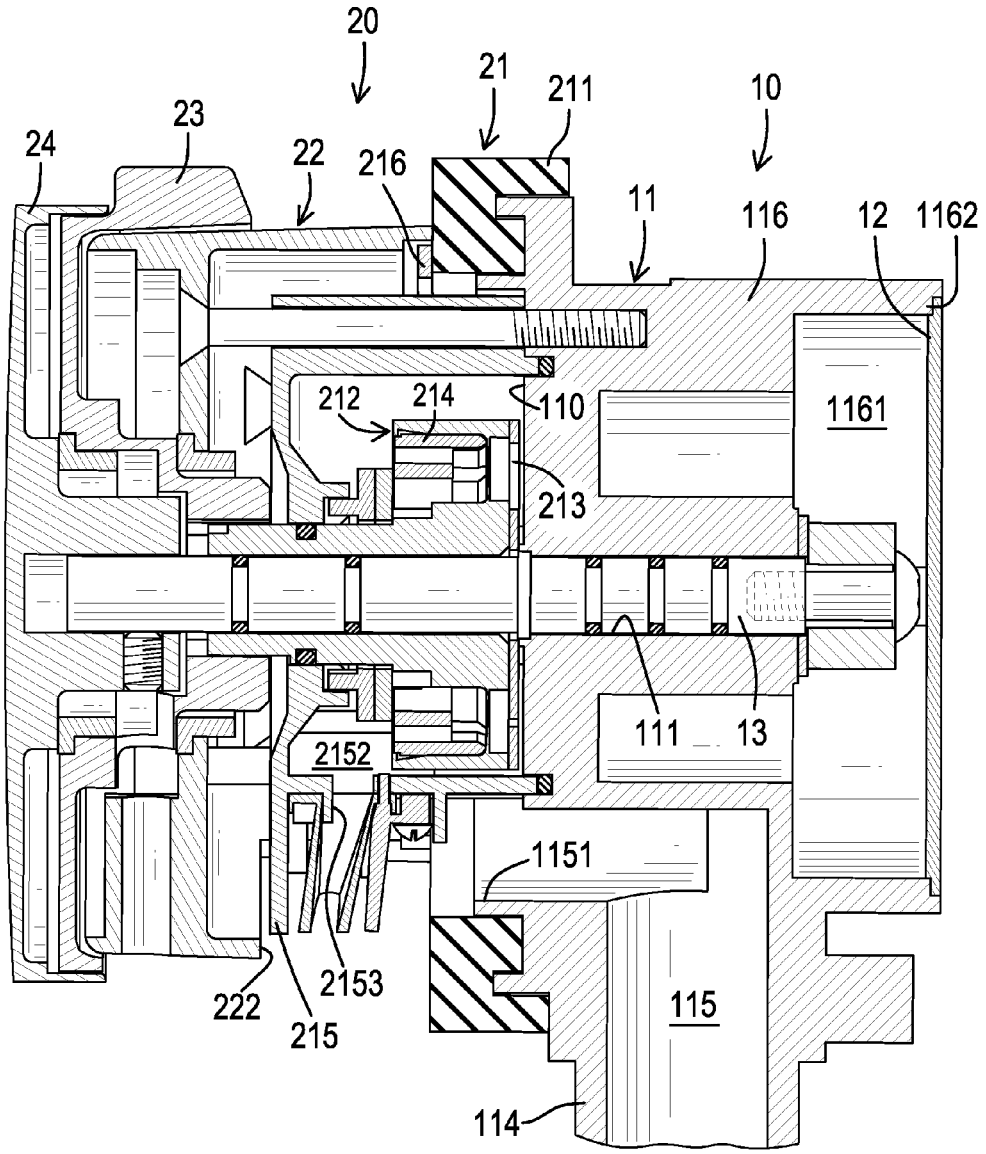
FIG. 2 is a side view in partial section of the all-in-one bath mixer assembly along line 2-2 in FIG. 1.
Figure 3:
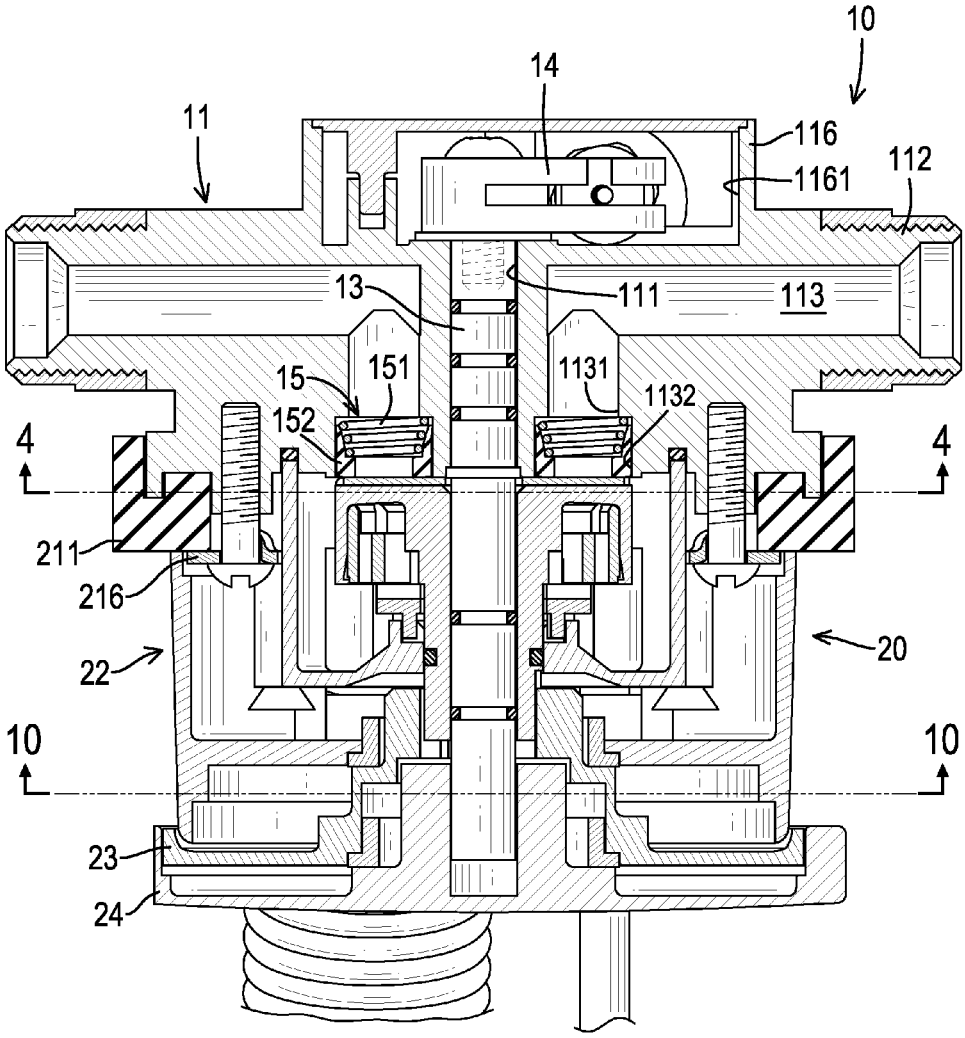
FIG. 3 is a top view in partial section of the all-in-one bath mixer assembly along line 3-3 in FIG. 1.

With reference to FIGS. 2 and 5, the overflow pipe 30 has an inlet end and an outlet end, and the inlet end of the overflow pipe 30 is connected with the overflow tube 114.

Figure 7:
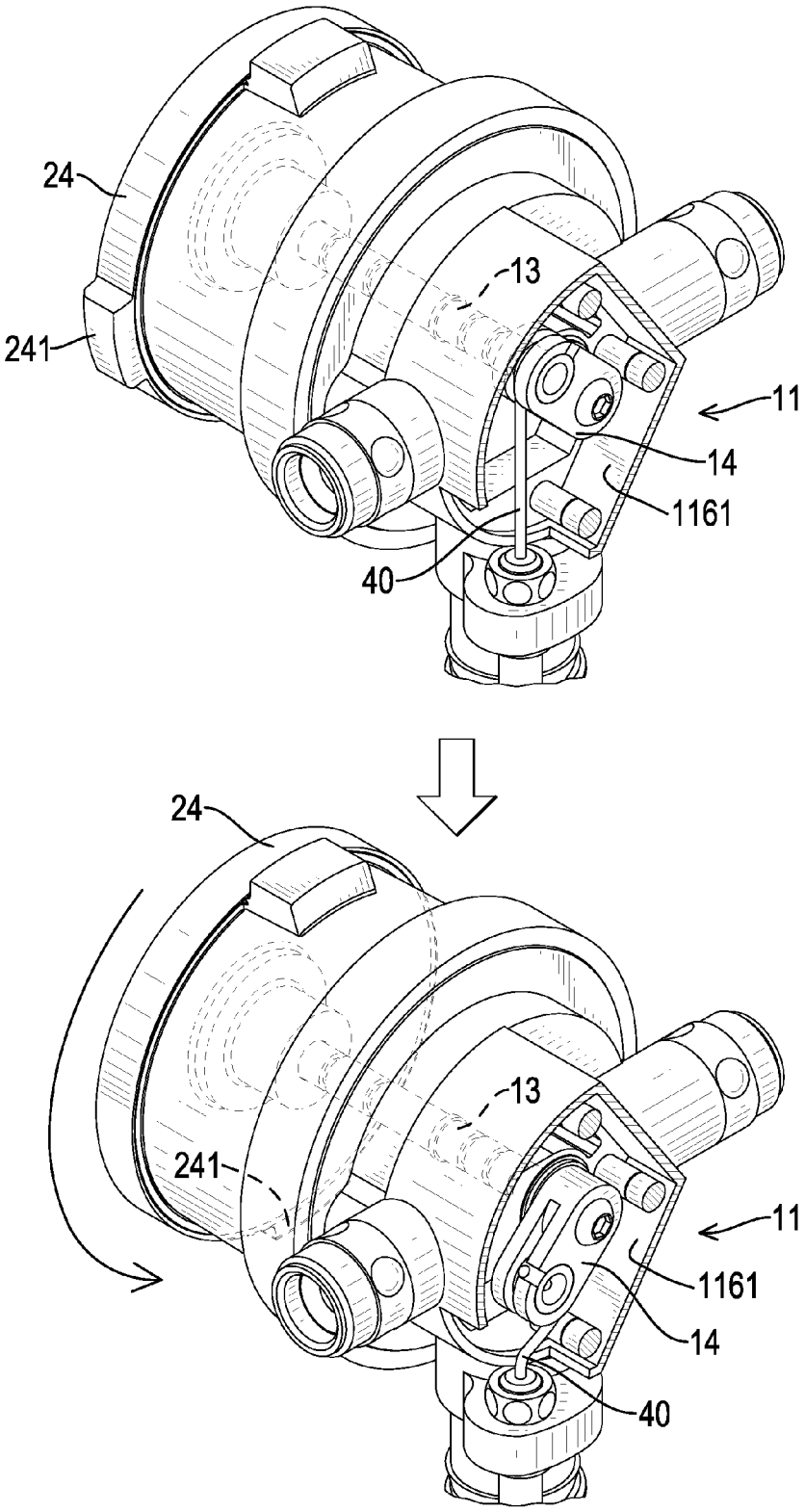
FIG. 7 shows operational perspective views in partial section of the water-flow controlling apparatus and a pulling rope of the all-in-one bath mixer assembly in FIG. 1.
Figure 8:
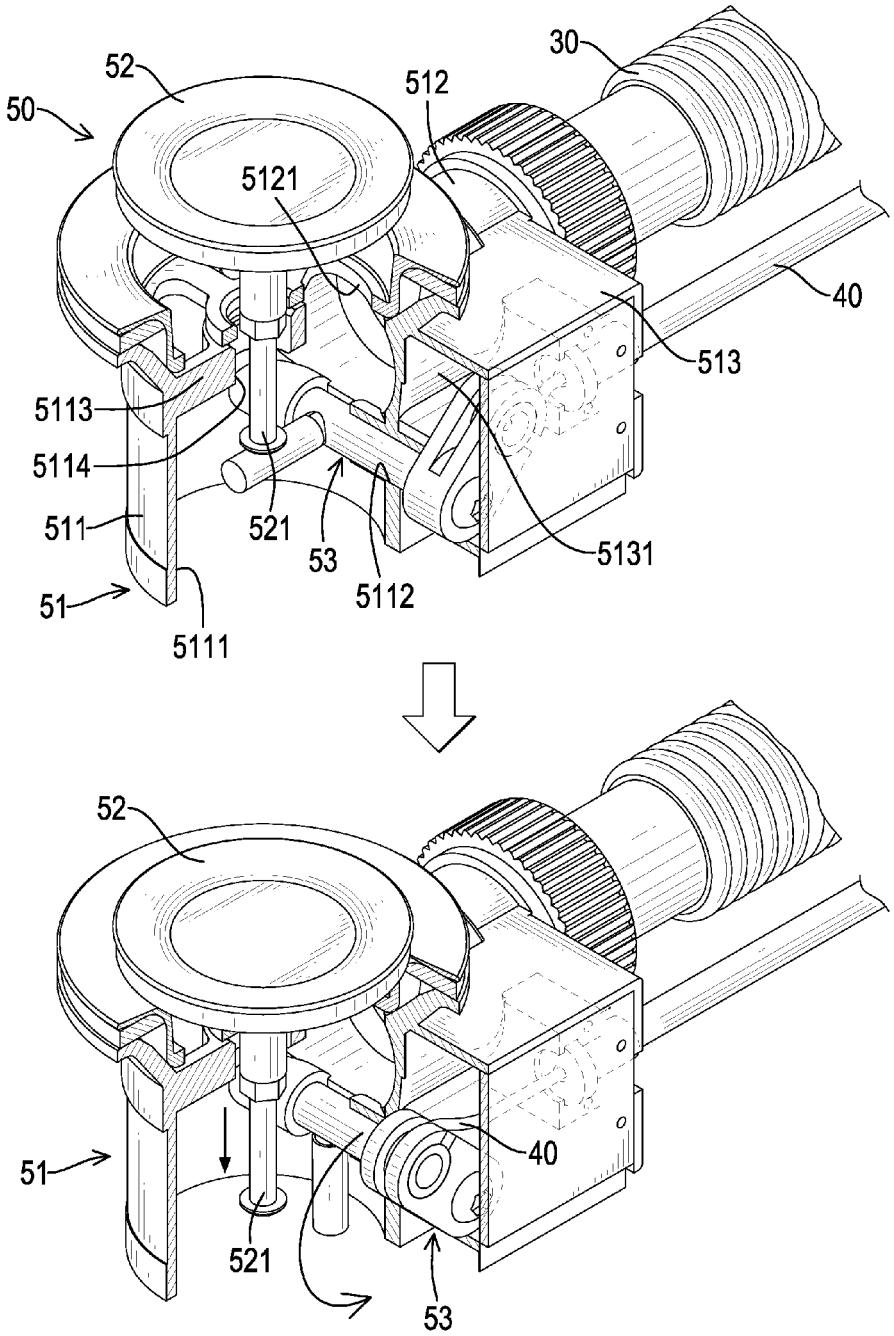
FIG. 8 shows other operational perspective views in partial section of the pulling rope and a water plug apparatus of the all-in-one bath mixer assembly in FIG. 1.

With reference to FIGS. 7 and 8, the pulling rope 40 is fixed in the positioning portion 117, can be controlled by rotating the plug controlling plate 24 and has a first end and a second end. The first end of the pulling rope 40 is connected with the swinging rod 14.

With reference to FIGS. 7 and 8, the water plug apparatus 50 is connected with the overflow pipe 30 and the pulling rope 40 and has a draining seat 51, a water plug 52 and a connecting rod 53. The draining seat 51 has a seat body 511, a connecting pipe 512 and a rope fixing portion 513. The seat body 511 is cylindrical and has a draining hole 5111, a rod hole 5112, a seat plate 5113 and a plug hole 5114. The draining hole 5111 is formed axially in the seat body 511 and has an axis. The rod hole 5112 is formed in the periphery of the seat body 511 and communicates with the draining hole 5111 and has an axis perpendicular to the axis of the draining hole 5111. The seat plate 5113 is mounted inside the draining hole 5111 and has multiple holes arranged circularly. The plug hole 5114 is formed through the center of the seat plate 5113.

The connecting pipe 512 is mounted on the outer surface of the seat body 511 and has a water passage 5121. The water passage 5121 is formed in the connecting pipe 512, communicates with the draining hole 5111 and has an axis perpendicular to the axis of the rod hole 5112.

The rope fixing portion 513 is mounted between the seat body 511 and the connecting pipe 512 and has an installing space 5131. The installing space 5131 is formed in the rope fixing portion 513 and communicates with the rod hole 5112. The second end of the pulling rope 40 is fixed in the rope fixing portion 513 and extents into the installing space 5131.

The water plug 52 is mounted moveably in the plug hole 5114, can move longitudinally and correspondingly to cover the draining hole 5111, and has an extending rod 521.

The connecting rod 53 is T-shaped, is mounted in the rod hole 5112 and is connected with the pulling rope 40. One end of the connecting rod 53 is located under the extending rod 521. When the pulling rope 40 is pulling, the connecting rod 53 is rotated to pull the extending rod 521 of the water plug 52 for opening or closing the draining hole 5111.

Figure 9:
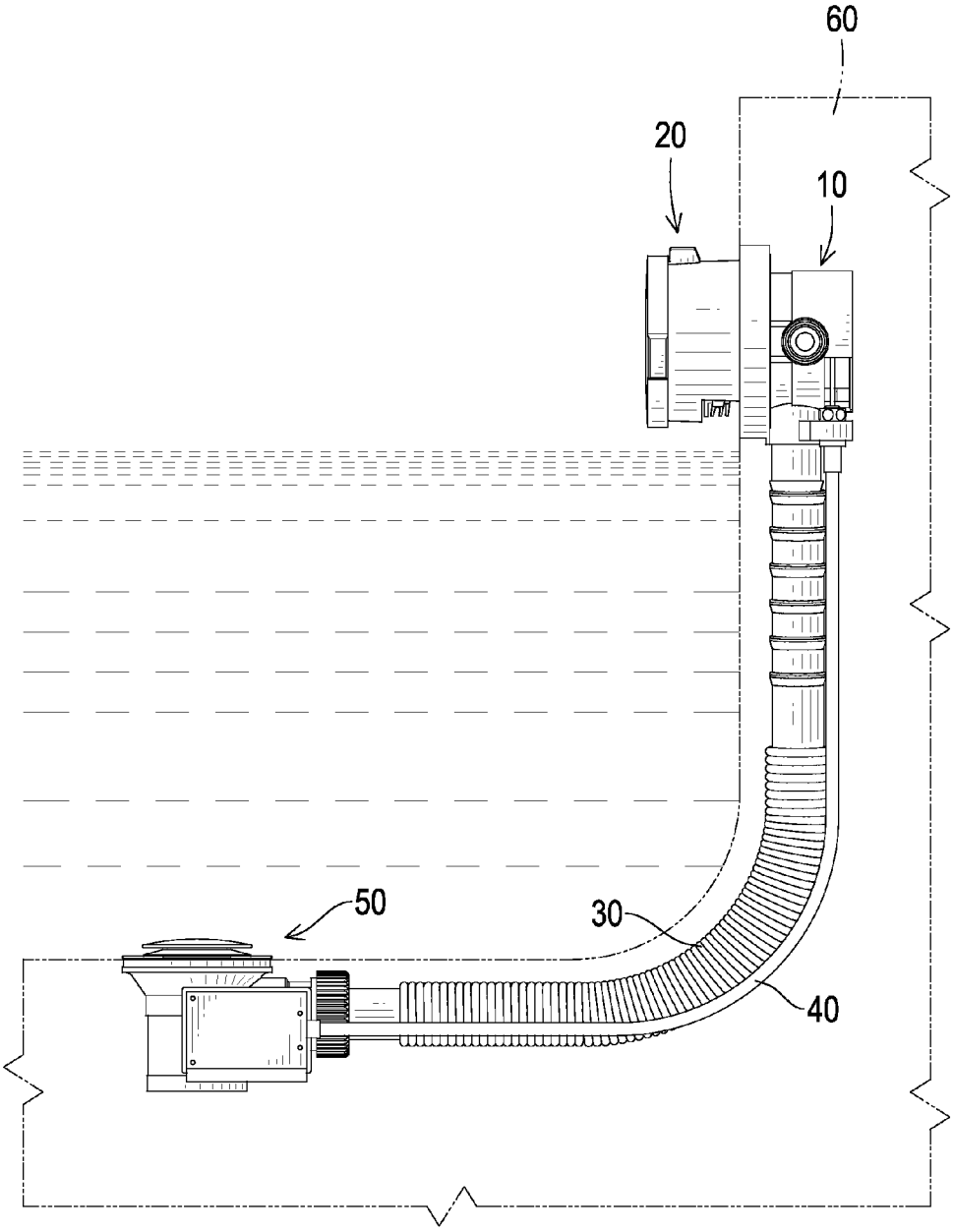
FIG. 9 is an operational side view of the all-in-one bath mixer assembly in FIG. 1 combined with a bathtub.

With reference to FIG. 9, the water controlling apparatus in accordance with the present invention can be installed in a bathtub 60. The water-flow controlling apparatus 10 is connected with a hot water source and a cold water source, and the water plug apparatus 50 closes an outlet of the bathtub 60 for keeping water inside the bathtub 60.

Figure 10:
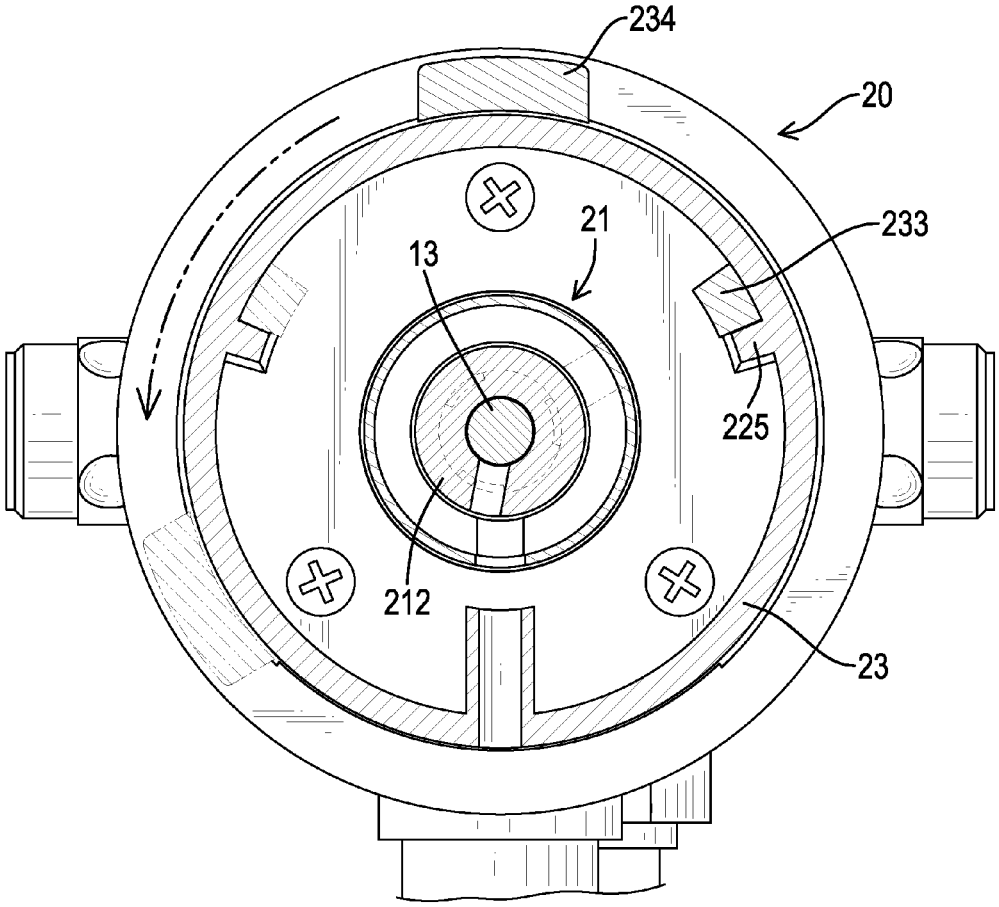
FIG. 10 is a cross-sectional front view of the all-in-one bath mixer assembly rotating along line 10-10 in FIG. 3.
Figure 11:
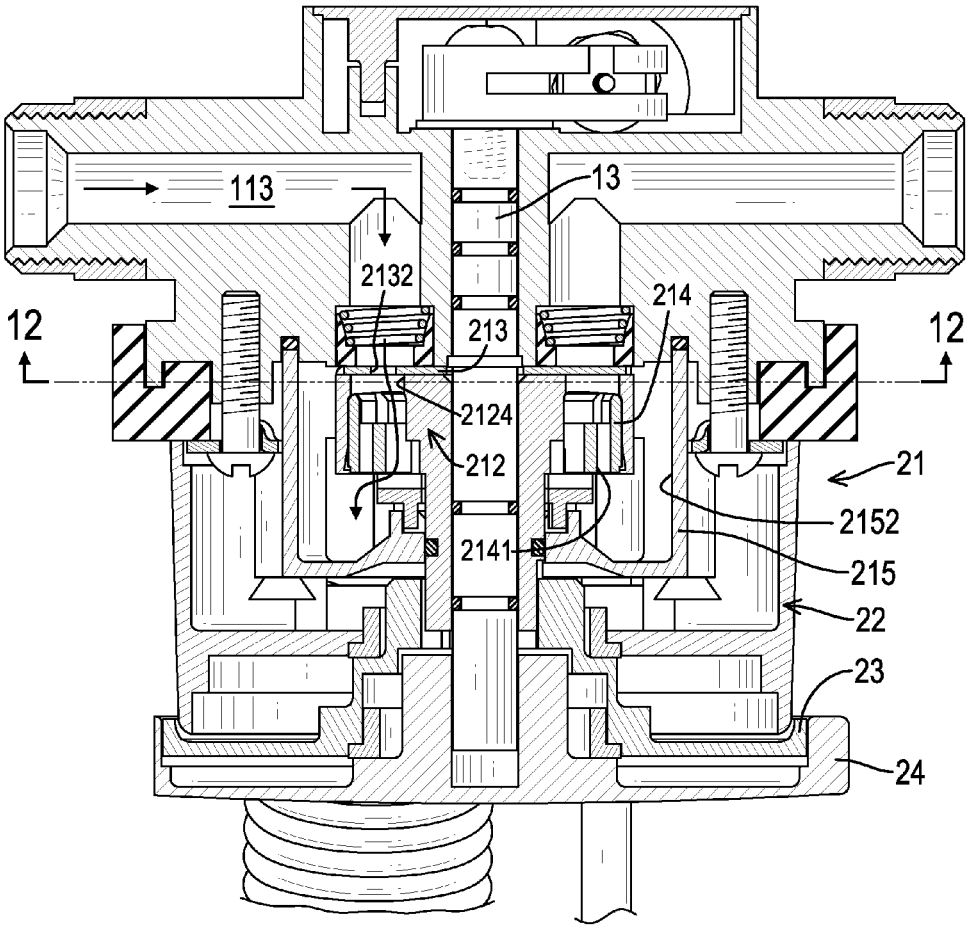
FIG. 11 is an operational cross-sectional top view of the all-in-one bath mixer assembly in FIG. 3.
Figure 12:
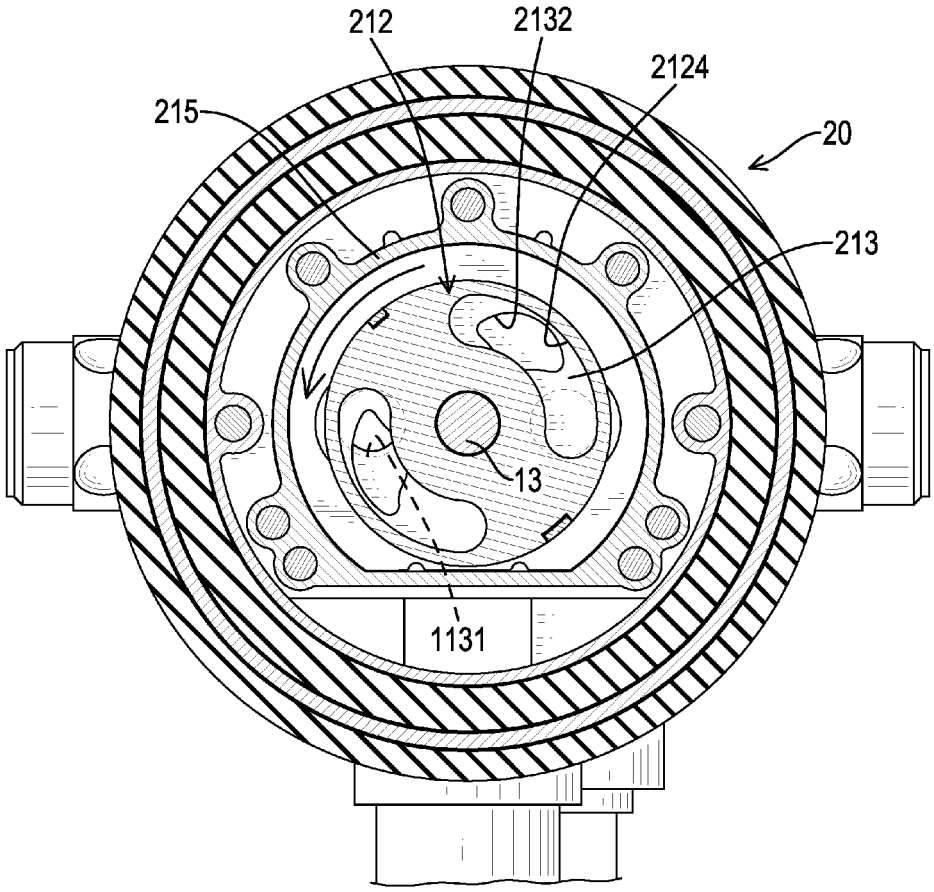
FIG. 12 is another cross-sectional front view of the all-in-one bath mixer assembly in FIG. 4.

With reference to FIGS. 10 to 12, the adjusting plate 23 is rotated to turn the adjusting unit 212, and the flow openings 2132 of the water blocking disc 213 communicate with the inlet passages 113. The water coming from the two water sources flows into the flowing space 2152 via the inlet passages 113, the flow openings 2132 and the water through hole 2141, and is mixed together in the flowing space 2152 so that the water will come out from the water outlet 2153 into the bathtub 60.

Figure 13:
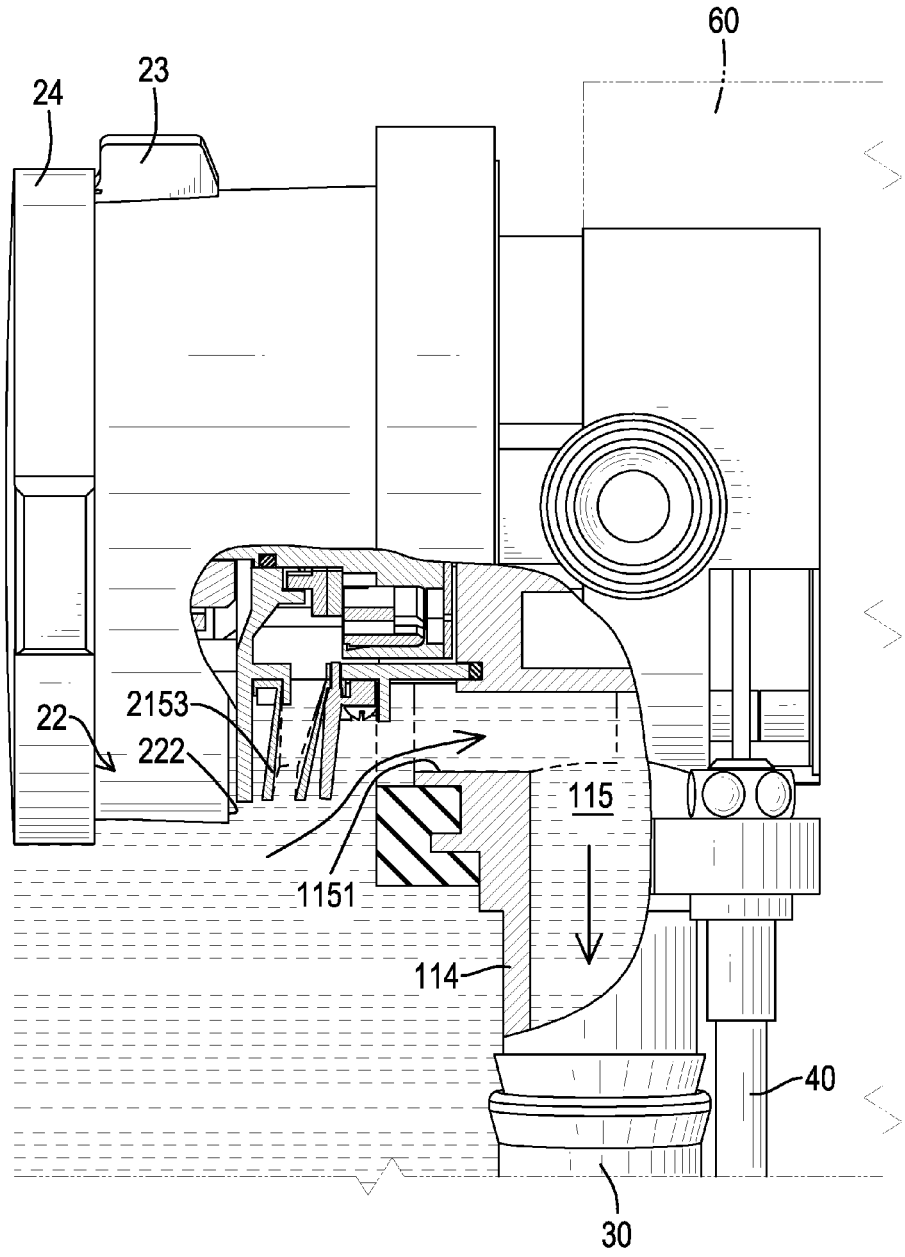
FIG. 13 is a cross-sectional side view in partial section of the all-in-one bath mixer assembly in FIG. 9, shown with water overflowing.

With reference to FIGS. 7, 8 and 13, when the amount of water is superfluous to flow over the overflow opening 1151, the excessive water flows into the overflow tube 114 and discharges to the water plug apparatus 50 via the outlet 115 and overflow pipe 30.

With reference to FIGS. 7 and 8, after the user takes the bath, the plug controlling plate 24 is rotated for draining water. The controlling rod 13 and the swinging rod 14 are rotated by the plug controlling plate 24. The pulling rope 40 is pulled by the swinging rod 14 and pulls the connecting rod 53. The water plug 52 is pushed by the connecting rod 53 and opens the draining hole 5111 for draining the water from the bathtub 60.

With such an arrangement, the water-flow controlling apparatus 10, the water-draining apparatus 20 and the water plug apparatus 50 are combined together as a single apparatus and are installed easily and quickly. The water-draining apparatus 20 is easy to use and has multiple functions such as turning on/off the water, adjusting the temperature of the water, managing the overflow, and controlling the water plug, etc.

What is claimed is:

1. An all-in-one bath mixer assembly comprising:

a water-flow controlling apparatus including a base having a front face;

a back face;

an axial hole formed in the front face;

two inlet pipes and an overflow tube mounted on the base;

a shell portion formed on the back face of the base;

a cover mounted on the shell portion;

a controlling rod inserted rotatably into the axial hole and having a first end and a second end; the first end of the controlling rod protruding from the front face and the second end of the controlling rod extending into the shell portion;

a swinging rod fixed at the second end of the controlling rod;

a water-draining apparatus mounted on a front side of the water-flow controlling apparatus and including a draining switcher mounted on the front face of the base and including an adjusting unit mounted around the controlling rod and having an outlet recess and at least one water guiding hole formed through the outlet recess;

a water blocking disc mounted on a back of the adjusting unit and having at least one flow opening corresponding in position to the at least one water guiding hole;

an outlet seat covering the front face of the base and having a water outlet formed in a bottom of the outlet seat;

a fixing seat mounted around the draining switcher;

an adjusting plate mounted on the fixing seat and having an engaging protrusion mounted around the controlling rod;

a plug controlling plate rotatably mounted on and covering the adjusting plate and fixed around the controlling rod; and an overflow pipe having an inlet end and an outlet end, the inlet end connected with the overflow tube;

a pulling rope fixed in the water-flow controlling apparatus and having a first end and a second end, the first end connected with the swinging rod; and a water plug apparatus connected with the overflow pipe and the pulling rope and including;

a draining seat connected with the outlet end of the overflow pipe and the second end of the pulling rope;

a water plug mounted moveably in the draining seat; and a connecting rod mounted in the draining seat and connected with the second end of the pulling rope.

2. The all-in-one bath mixer assembly as claimed in claim 1, wherein the adjusting unit has a cap and a connecting shaft formed on the cap, and the outlet recess of the adjusting unit is formed around the connecting shaft and located inside the cap.

3. The all-in-one bath mixer assembly as claimed in claim 2, wherein the connecting shaft is a spline shaft, and the engaging protrusion has an engaging socket; the engaging socket is a spline socket and engages correspondingly with the connecting shaft.

4. The all-in-one bath mixer assembly as claimed in claim 3, wherein the draining switcher further has an outlet ring, the outlet ring is mounted in the outlet recess and has multiple through holes, and the through holes communicate with the at least one water guiding hole.

5. The all-in-one bath mixer assembly as claimed in claim 4, wherein the draining switcher further has a positioning ring and an engaging plate, the positioning ring is mounted on a periphery of the base, and the engaging plate is mounted between the positioning ring and the outlet seat by screws.

6. The all-in-one bath mixer assembly as claimed in claim 1, wherein the fixing seat has a front surface, an assembling recess and three blocks; the assembling recess is formed in the front surface of the fixing seat, the blocks are mounted in the assembling recess and are disposed along a periphery of the front surface of the fixing seat at equal intervals; the adjusting plate has an engaging block and is located between two of the blocks.

7. The all-in-one bath mixer assembly as claimed in claim 2, wherein the fixing seat has a front surface, an assembling recess and three blocks; the assembling recess is formed in the front surface of the fixing seat, the blocks are mounted in the assembling recess and are disposed along a periphery of the front surface of the fixing seat at equal intervals; the adjusting plate has an engaging block and is located between two of the blocks.

8. The all-in-one bath mixer assembly as claimed in claim 3, wherein the fixing seat has a front surface, an assembling recess and three blocks; the assembling recess is formed in the front surface of the fixing seat, the blocks are mounted in the assembling recess and are disposed along a periphery of the front surface of the fixing seat at equal intervals; the adjusting plate has an engaging block and is located between two of the blocks.

9. The all-in-one bath mixer assembly as claimed in claim 4, wherein the fixing seat has a front surface, an assembling recess and three blocks; the assembling recess is formed in the front surface of the fixing seat, the blocks are mounted in the assembling recess and are disposed along a periphery of the front surface of the fixing seat at equal intervals; the adjusting plate has an engaging block and is located between two of the blocks.

10. The all-in-one bath mixer assembly as claimed in claim 5, wherein the fixing seat has a front surface, an assembling recess and three blocks; the assembling recess is formed in the front surface of the fixing seat, the blocks are mounted in the assembling recess and are disposed along a periphery of the front surface of the fixing seat at equal intervals; the adjusting plate has an engaging block and is located between two of the blocks.

11. The all-in-one bath mixer assembly as claimed in claim 6, wherein the shell portion is fan-shaped and has a shell opening, and the cover corresponds to and is covered on the shell opening.

12. The all-in-one bath mixer assembly as claimed in claim 7, wherein the shell portion is fan-shaped and has a shell opening, and the cover corresponds to and is covered on the shell opening.

13. The all-in-one bath mixer assembly as claimed in claim 8, wherein the shell portion is fan-shaped and has a shell opening, and the cover corresponds to and is covered on the shell opening.

14. The all-in-one bath mixer assembly as claimed in claim 9, wherein the shell portion is fan-shaped and has a shell opening, and the cover corresponds to and is covered on the shell opening.

15. The all-in-one bath mixer assembly as claimed in claim 10, wherein the shell portion is fan-shaped and has a shell opening, and the cover corresponds to and is covered on the shell opening.

* * * * *